US005431812A

United States Patent [19]

Abraham

[11] Patent Number: 5,431,812

[45] Date of Patent: Jul. 11, 1995

[54] COKING PROCESS

[75] Inventor: Ooriapadical C. Abraham, Nederland, Tex.

[73] Assignee: Texaco Inc., White Plains, N.Y.

[21] Appl. No.: 206,581

[22] Filed: Mar. 7, 1994

[51] Int. Cl.[6] ..... C10G 9/14

[52] U.S. Cl. ..... 208/131; 208/132; 208/85

[58] Field of Search ..... 208/131, 132, 85

[56] References Cited

U.S. PATENT DOCUMENTS 4,058,451 11/1977 Stolfa ..... 208/131
4,404,092 9/1983 Audeh et al. ..... 208/131
4,534,854 8/1985 Weinberg et al. ..... 208/131

*Primary Examiner*—Asok Pal
*Assistant Examiner*—Walter D. Griffin
*Attorney, Agent, or Firm*—James L. Bailey; Kenneth R. Priem; Richard A. Morgan

[57] ABSTRACT

A feedstock composition comprising residuum fractions and deasphalter bottoms is formulated by use of a carbon residue characterization factor. It has been found in the feedstock composition that the character of carbon residue is determinative of the coke quality. The process is used to make coke having a sulfur concentration of 0.5 to 0.9 of the feedstock composition sulfur.

10 Claims, 1 Drawing Sheet

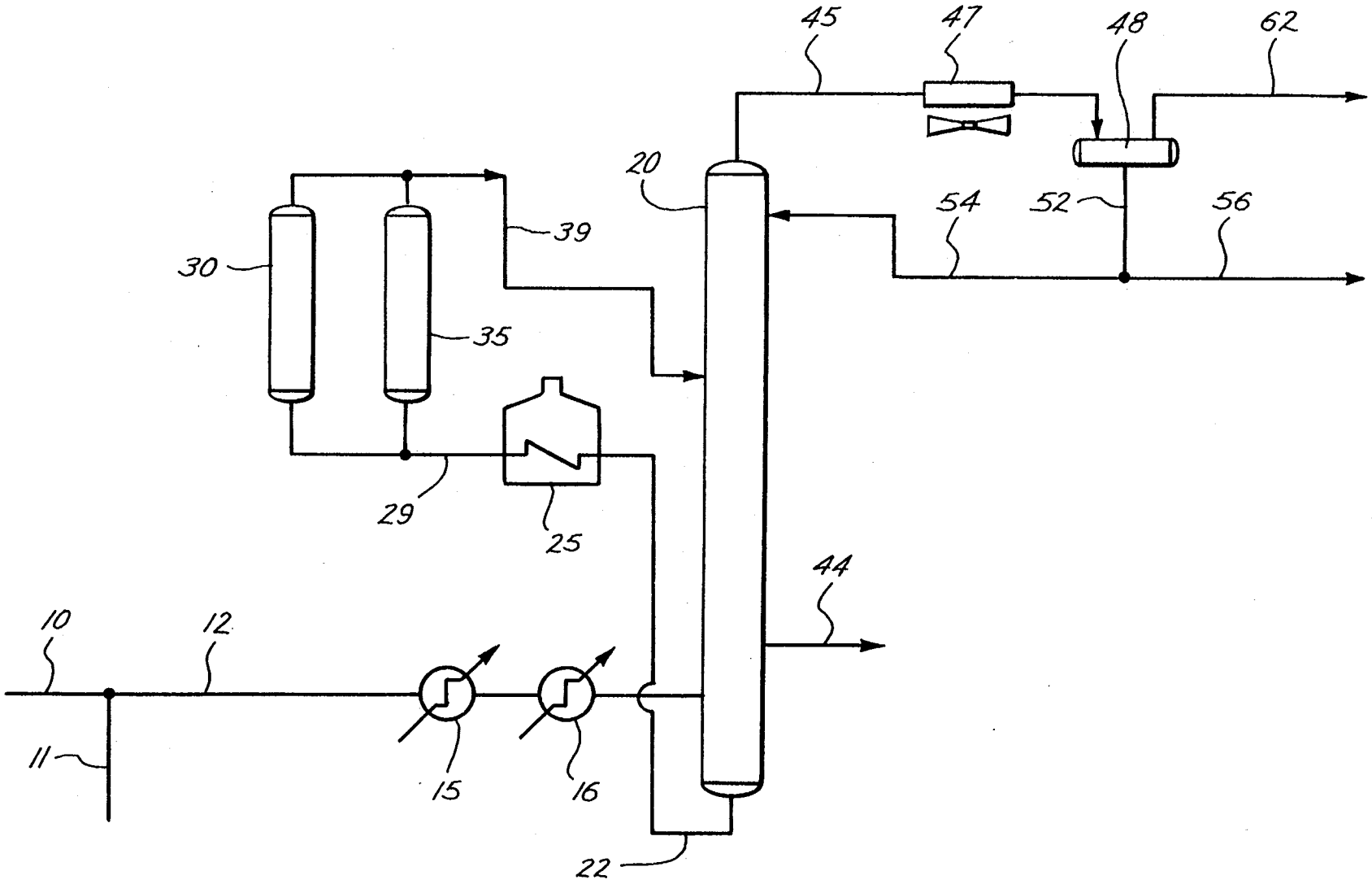
62
56
48
52
47
54
45
44
20
22
39
25
16
35
15
29
30
12
10
11

COKING PROCESS

BACKGROUND OF THE INVENTION

1. Field of the Invention

The invention relates to a petroleum refining process. More particularly, the invention relates to a coking process for converting petroleum based feedstocks to coke, hydrocarbon liquids and gases. Most particularly the invention relates to converting a sulfur containing residual hydrocarbon feedstock to low sulfur coke.

2. Description of other Related Methods in the Field

In a coking process, a heavy liquid hydrocarbon fraction is converted to solid coke and lower boiling liquid and gaseous products. The heavy liquid hydrocarbon fraction is typically a residual petroleum based oil or a mixture of residual oil with other heavy hydrocarbon fractions.

In a typical delayed coking process, the residual oil is heated by exchanging heat with liquid products from the process and is fed into a fractionating tower wherein light end products are removed from the residual oil. The residual oil is then pumped from the bottom of the fractionating tower through a tube furnace where it is heated under pressure to coking temperature and discharged into a coking drum.

In the coking reaction residual oil feedstock is thermally decomposed into solid coke, condensable liquid and gaseous hydrocarbons. The liquid and gaseous hydrocarbons are continuously removed from the coke drum and returned to the fractionating tower where they are separated into the desired hydrocarbon fractions.

When the coke drum becomes filled with coke, the flow of feedstock is terminated and solid coke is recovered from the coking drum. Coke quality determines its use. Two grades of high purity coke are used to manufacture electrodes for the steel and aluminum industry. Lower purity coke is used for fuel. The value of lower purity coke is calculated based on the sulfur and heavy metal impurities which are transferred from the feedstock to the coke.

Premium coke is a high purity grade of coke used for the manufacture of large graphite electrodes used in electric arc furnaces for the production of steel. The quality of premium coke is measured by its coefficient of thermal expansion (CTE) which may vary from as low as 0 to as high as $8\times10^{-7}$ centimeters per centimeter per degree centigrade. The best premium grade coke has a CTE of $5\times10^{-7}$ cm/cm/°C. or less.

Aluminum grade coke is another high purity grade of coke used for the manufacture of electrodes for the production of aluminum. Aluminum grade coke is of lesser purity than premium grade coke and contains amounts of sulfur and nitrogen. The CTE of aluminum grade coke is also substantially higher than the requirement of premium grade coke.

U.S. Pat. No. 5,045,177 to J. C. Cooper et al. teaches a delayed coking process in a residual oil feedstock is converted to coke, liquid hydrocarbon and a sweet gas fraction.

SUMMARY OF THE INVENTION

The invention is an improved coking process such as a delayed coking process. The process comprises converting a sulfur containing residual hydrocarbon oil feedstock composition at coking reaction conditions.

The reaction product comprises coke, hydrocarbon liquids and gas.

In the improvement, the amount of pentane insoluble material in the feedstock composition is measured according to ASTM D-893. The amount of carbon residue in the feedstock composition is measured according to ASTM D-4530. A feedstock characterization factor is calculated according to the formula:

$$\text{feedstock characterization factor} = \frac{\text{amount of pentane insoluble material}}{\text{amount of carbon residue}}$$

Pentane insoluble material is added to the feedstock composition as a minor portion in an amount to maintain the feedstock characterization factor at 1.0 or greater, preferably 1.0 to 2.0. As a result, the coke sulfur concentration comprises 0.5 to 0.9 of the feedstock sulfur concentration.

The process has particular utility in making anode grade coke.

BRIEF DESCRIPTION OF THE DRAWING

The drawing is a process flow diagram of a delayed coking process with fractionation facilities for gas and liquid recovery.

DETAILED DESCRIPTION OF THE DRAWING

The residual oil for the process may be any hydrocarbon oil derived from petroleum, shale oil, tar sands or coal and containing a large proportion of oil boiling above 1000° F. (538° C.). Examples of heavy hydrocarbon oil feedstocks suitable for use according to the invention are petroleum atmospheric distillation bottoms, petroleum vacuum distillation bottoms, tar sand bitumen, coal derived hydrocarbons, hydrocarbon residues, heavy gas oil, heavy cycle gas oil, deasphalted oil, deasphalter asphalt, lube extracts and mixtures thereof. These hydrocarbon oils comprise amounts of sulfur ranging generally from 2 wt % to 10 wt %, typically 4 wt % to 8 wt %.

Reference is made to the Drawing. A residual oil, preferably atmospheric residuum, vacuum residuum, or mixtures thereof is flowed through line 10 where it is mixed with a pentane-insoluble asphaltene containing fraction such as deasphalter bottoms in line 11 to form the feedstock composition of the process in line 12.

The proportion of residual oil in line 10 to deasphalter bottoms fraction in line 11 which makes up the feedstock for the process in line 12 is critical. A sample of feedstock is taken from line 12 and analyzed for carbon residue according to ASTM D-4530 and for pentane insoluble material according to ASTM D-893. From these two measurements a feedstock characterization factor is calculated.

Feedstock having a characterization factor of 1.0 and greater have been found to produce anode grade coke having 2.5 wt % or less sulfur. Anode grade coke has a greater market value than lesser grade coke having greater amounts of sulfur. It has been found that the amount of pentane insoluble material in the feedstock can be used to control the sulfur content in the coke. Should the characterization factor fall below 1.0, the proportion of pentane insoluble material in the feedstock is increased until the factor is 1.0 or greater. The result is an anode grade coke.

The invention parameters have been found by experimentation. In a conventional coking reaction, a disproportionate amount of sulfur in the feedstock becomes incorporated into the coke. Empirically, the concentration of sulfur in the coke is 1.3 to 1.6 times the concentration of sulfur in the feedstock. For example, a feedstock containing 3 wt % sulfur would yield a coke containing 3.9 wt % to 4.8 wt % sulfur.

Applicant has discovered that the proportion of the sulfur passed from a feedstock to the coke product can be changed by selecting the feedstock composition. Applicant has found that a feedstock can be formulated to produce a coke having a sulfur concentration of 0.5 to 0.9 times the concentration of sulfur in the feedstock.

Applicant has discovered that petroleum coke may be effectively desulfurized in situ as it is produced. That sulfur which is not incorporated into the coke is recovered in the hydrocarbon liquid and gas products. The addition of pentane insoluble material to a conventional coking feedstock in specified amounts brings about the in situ desulfurizing of the coke. The process is used to produce anode grade coke having a consistent and desirable quality of 2.5 wt % or less sulfur.

Deasphalter bottoms is the bottoms product of liquid-liquid extraction carried out by contacting a residuum hydrocarbon stock with a low molecular weight paraffin deasphalting solvent such as propane, normal butane, isobutane or pentane. The countercurrent contacting is carried out at deasphalting conditions, generally at a temperature in the range of 100° F. (38° C.) to 250° F. (121° C.), a dosage of from 400 to 1000 vol % solvent/oil and a pressure of about 200 psig (14.6 atm) to 1000 psig (69 atm). The actual deasphalting conditions chosen are dependent on the solvent. That is, the temperature chosen should not exceed the critical temperature of the solvent and the pressure is maintained above the autogenous pressure to present vaporization. Asphalt and associated solvent soluble materials collectively described as asphaltic residue are removed. These asphaltic residues are the feedstocks of the process. They are chemically characterized as having amounts of asphaltenes and other pentane insoluble hydrocarbons measured by ASTM D-893.

The feedstock composition is heated with heat integration in heat exchangers 15 and 16 and passed to the lower portion of coker fractionator 20.

Essentially all of this feedstock composition passes out the bottom of coker fractionator 20, via line 22 to tube furnace 25. The feedstock is heated in tube furnace 25 under pressure to coking temperature and then passed rapidly to either one of two coke drums 30 and 35.

Coke drums 30 and 35 are operated cyclically. One drum, e.g. coke drum 30, is filled with feedstock via line 29 and coked, producing coke, condensable hydrocarbon liquids and vapors. The other drum, e.g. coke drum 35, is emptied of coke, and readied for refilling. Coke is withdrawn from the lower end of coke drum 35 by removing the lower head (not shown). Hydrocarbon condensable liquids and vapors are continuously withdrawn via conduit 39 and passed to coker fractionator 20.

The coking reaction is a thermal decomposition of hydrocarbon residuum feedstock. This reaction is carried out at temperatures of 850° F. (454° C.) to 1000° F. (538° C.) and pressures of 1 atm to 8 atm. Although large quantities of coke are produced, the coking process also yields condensable hydrocarbon liquids and vapors. The hydrocarbon products include in various proportions, the full range of hydrocarbons from methane and ethane to a heavy coker gas oil consisting of a 650° F. (343° C.) to 800° F. (427° C.) fraction. Hydrocarbon liquids boiling above about 800° F. (427° C.) are passed via line 22 back to coke drums 30 and 35.

Boiling between the methane-ethane fraction and the heavy coker gas oil fraction are a number of intermediate boiling hydrocarbons which are taken as fractions selected by product demand and the refining equipment available to recover them. These products include fuel gas, propane/propylene, butane/butylene, light naphtha, heavy naphtha, light coker gas oil boiling between 400° F. (204° C.) and 650° F. (343° C.), and heavy coker gas oil boiling above 650° F. (343° C.) to about 850° F. (454° C.).

A number of liquid fractions can be withdrawn as side streams from the coker fractionator generically shown as side stream 44. Multiple side streams may be taken for fractions such as light coker gas oil and heavy coker gas oil, represented by side stream 44. Each of these fractions comprises mercaptans produced in the delayed coking reaction. Such a configuration is shown by example in U.S. Pat. No. 4,686,027 to J. A. Bonilla et al. incorporated herein by reference.

The invention is useful for converting petroleum residuum feedstocks containing 2 wt % or more sulfur. High sulfur and very sour are defined herein as stocks containing 4 wt % or more sulfur, typically 5 wt % or more. This amount of sulfur can be even higher, e.g. 8 wt % or 10 wt %. The commercial value of a feedstock generally diminishes with an increased amount of sulfur. This is attributable in large part to the requirement to remove the sulfur from products. Sulfur from the feedstock is distributed to some extent among all the products from light hydrocarbon gas to coke. A portion of the sulfur is converted in the delayed coking process to hydrogen sulfide. Hydrogen sulfide is found in the $C_1$ to $C_3$ boiling products because of its boiling point. They are withdrawn together via line 62. A substantial portion of the sulfur which is not converted to hydrogen sulfide is found in the coke.

A wide boiling range overhead fraction is taken from coker fractionator 20 via line 45. The fraction passes through air fin condenser and cooler 47 which condenses a substantial portion of the fraction forming a mixed vapor/liquid mixture which is passed to accumulator 48. Essentially all of the hydrogen sulfide produced in coke drums 30 and 35 passes through accumulator 48. It is also understood that amounts of sulfur are in forms other than hydrogen sulfide. For example, sulfur in the form of mercaptans is present in the hydrocarbon liquid.

A portion of the hydrocarbon liquid from accumulator 48 is returned to coker fractionator 20 as reflux under temperature control via line 52 and reflux line 54. The remaining sour liquid is withdrawn under level control via line 56.

The material which does not vaporize and remain in the vessel is a thermal tar. As the coking reaction progresses, the coke drum fills with thermal tar which is converted over time at these coking reaction conditions to coke. At the end of the coking cycle, the coke is removed from the drum by cutting with a high impact water jet. The cut coke is washed to a coke pit and coke dewatering pad. The coke may be broken into lumps and may be calcined at a temperature of 2000° F. (1093°

C.) to 3000° F. (1649° C.) prior to sampling and analysis for grading.

Premium grade coke, referred to in the art as needle grade coke, is used to make steel and for specialty alloy applications. This product has a coefficient of thermal expansion of 0.5 to $5\times10^{-7}$ cm/cm/°C., an ash content of 0.001 to 0.02 wt %, volatiles of about 3 to 6 wt % and sulfur of about 0.1 to 1 wt %.

Aluminum grade coke, referred to in the art as anode grade coke, is used in the manufacturing of aluminum. This product has a density of about 0.75 to 0.90 gm/cc, an ash content of about 0.05 to 0.3 wt %, volatiles of about 7 to 11 wt % and sulfur of about 0.5 to 2.5 wt %.

Fuel grade coke typically has an ash content of about 0.1 to 2 wt %, volatiles of about 8 to 20 wt % and sulfur of about 1 to 7 wt %.

This invention is shown by way of example.

EXAMPLE

Vacuum residua were blended with amounts of deasphalter bottoms to produce a feedstock composition and coked in a bench scale apparatus at the following conditions:

TABLE I

| DELAYED COKER OPERATING CONDITIONS | |
|---|---|
| Heater Outlet Temp. | 900° F. (482° C.) to 980° F. (527° C.) |
| Heater Pressure | 350 psig (24.8 atm) |
| Heater Residence Time | 50 sec. |
| Coke Drum Pressure | 50 psig (4.4 atm) |
| Coke Drum Cycle Time | 24 hours |
| Coke Drum Vapor Velocity | 0.4 ft/sec. (12.2 cm/sec) |
| Recycle Ratio (Fraction of unconverted feedstock composition) | 0.1 to 0.3 |

TABLE II

| Vacuum Residuum | San Ardo | Alaska N Slope | Santa Maria | San Joaquin | Hondo | Hueso | Huntington Beach | Wilmington Thums | Wilmington Sun Oil | Wilmington Exxon |
|---|---|---|---|---|---|---|---|---|---|---|
| Sulfur, wt % | 2.84 | 2.38 | 6.89 | 1.7 | 7.09 | 5.2 | 2.40 | 2.43 | 2.71 | 3.35 |
| Feedstock Characterization Factor | 1.38 | 0.96 | 1.79 | 1.14 | 2.13 | 1.19 | 1.34 | 1.41 | 1.20 | 1.26 |
| Coke Sulfur, wt % | 1.55 | 3.12 | 5.85 | 0.85 | 5.28 | 4.82 | 1.18 | 1.37 | 2.10 | 2.40 |
| Coke S/Feed S | 0.54 | 1.31 | 0.85 | 0.5 | 0.74 | 0.92 | 0.49 | 0.56 | 0.77 | 0.71 |

| Vacuum Residuum | West LA | Signal Hill | Harvest | Bitumen | H-Oil ® Resid | Arab Lt | Arab MED | Arab Hvy | Shale Oil |
|---|---|---|---|---|---|---|---|---|---|
| Sulfur, wt % | 2.71 | 2.29 | 5.63 | 5.3 | 2.9 | 3.88 | 4.16 | 4.65 | 0.5 |
| Feedstock Characterization Factor | 1.35 | 1.32 | 1.59 | 0.42 | 0.72 | 0.68 | 0.81 | 0.99 | 0.87 |
| Coke Sulfur, wt % | 1.74 | 1.44 | 4.66 | 5.96 | 3.6 | 6.14 | 6.97 | 7.40 | 0.6 |
| Coke S/Feed S | 0.64 | 0.63 | 0.83 | 1.12 | 1.24 | 1.58 | 1.67 | 1.59 | 1.16 |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A coking process for the conversion of a residual oil feedstock composition having a feedstock composition sulfur concentration, to produce coke, hydrocarbon liquid and gas, the process comprising the steps of:

a. measuring an amount of pentane insoluble material in the feedstock composition according to ASTM D-893, b. measuring an amount of carbon residue in the feedstock composition according to ASTM D-4530, c. calculating a feedstock characterization factor according to the formula:

$$\text{Feedstock characterization factor} = \frac{\text{amount of pentane insoluble material}}{\text{amount of carbon residue}}$$

d. adding pentane insoluble material to the feedstock composition as a minor portion in an amount to maintain the feedstock characterization factor at 1.0 or greater, and e. subjecting the feedstock composition to coking reaction conditions, thereby producing coke having a sulfur concentration 0.5 to 0.9 of the feedstock composition sulfur concentration.

2. The process of claim 1 wherein the pentane insoluble material is added in an amount to produce coke comprising 0.5 wt % to 2.5 wt % sulfur.

3. The process of claim 1 wherein the pentane insoluble material comprises asphaltic residue.

4. The process of claim 1 wherein the feedstock characterization factor is maintained in the range of 1.0 to 2.0.

5. The process of claim 1 wherein the feedstock composition comprises 2 wt % to 10 wt % sulfur.

6. The process of claim 1 wherein the feedstock composition comprises 4 wt % to 8 wt % sulfur.

7. The process of claim 1 wherein the feedstock composition comprises as a major portion atmospheric residuum, vacuum residuum and mixtures thereof.

8. The process of claim 1 wherein the feedstock composition comprises vacuum residuum as a major portion.

9. The process of claim 1 wherein the feedstock composition comprises unconverted recycled feedstock.

10. The process of claim 1 wherein the coking is carried out by delayed coking.

* * * * *